US006967441B2

(12) United States Patent
Sun et al.

(10) Patent No.: US 6,967,441 B2
(45) Date of Patent: Nov. 22, 2005

(54) PLASMA DISPLAY PANEL FOR MULTI-SCREEN SYSTEM

(75) Inventors: Boyan Sun, Zhejiang Province (CN); Yiting Yu, Zhejiang Province (CN)

(73) Assignee: Ningbo Tianming Electronic Co. Ltd, (CN)

( * ) Notice: Subject to any disclaimer, the term of this patent is extended or adjusted under 35 U.S.C. 154(b) by 123 days.

(21) Appl. No.: 10/748,005

(22) Filed: Dec. 29, 2003

(65) Prior Publication Data

US 2004/0160184 A1 Aug. 19, 2004

(30) Foreign Application Priority Data

Dec. 31, 2002 (CN) ..... 02295462 U
Mar. 28, 2003 (CN) ..... 03116072 A

(51) Int. Cl.[7] ..... H01J 17/49
(52) U.S. Cl. ..... 313/582; 313/584
(58) Field of Search ..... 313/582–586, 313/634, 635, 493; 445/23

(56) References Cited

U.S. PATENT DOCUMENTS 5,990,616 A * 11/1999 Lee et al. ..... 313/582

* cited by examiner

*Primary Examiner*—Vip Patel
(74) *Attorney, Agent, or Firm*—Lumen Intellectual Property Services, Inc.

(57) ABSTRACT

A plasma display panel for multi-screen system comprising a front and a back dielectric plates; transparent and addressing electrodes orthogonally located between the plates; display cells defined by the mutually orthogonal electrodes; barrier ribs for separating and defining display cells from each other; and a very narrow sealing seam for sealing edge parts of the two plates. The sealing seam has a width ranging from about 0.3 mm to about 1.5 mm. The sealing material is a glass powder having a special composition that enables a low melting point. A concave groove accommodates the sealing material. The present invention prevents the image from missing between the adjacent units in the display matrix and eliminates the dark matrix border lines.

11 Claims, 3 Drawing Sheets

PLASMA DISPLAY PANEL FOR MULTI-SCREEN SYSTEM

BACKGROUND OF THE INVENTION

1. Field of the Invention

The present invention relates generally to plasma display panels and more particularly to a structure of a plasma display panel for multi-screen screen system in which the sealing seams are substantially narrowed, thereby reducing width of noticeable connected portion on the screen.

2. Description of the Related Art

An exemplary prior art plasma display panel (PDP) is shown in FIG. 1. This plasma display panel comprises a front glass plate, a back glass plate, sealing seams 3, barrier ribs 9, phosphor layer 10, and display cells 11. The front glass plat consists of transparent glass sheet 1, transparent electrodes 4, dielectric layer 5, and protective layer 6. The back glass plate consists of a glass sheet 2, addressing electrodes 7, and dielectric layer 8.

The front plate and back plate are bonded together with low melting point glass to form a discharge gas space therebetween. To make four line of sealing seam on the inside surface of the plates along matrix border line, it is necessary to first coat or print the sealing seams 3 with a special sealing material comprising of $SiO_2$, PbO, and $B_2O_3$. Consequently, after coating, there is a heat treatment process within the range of temperature of 400° C.–500° C. The front glass plate and back glass plate are then sealed to form a semi-finished assembly of the PDP. Next, the residual gas is drawn from the space between the front glass plate and the back glass plate. Finally, the inert gas is filled into the space to finish the PDP assembly.

Some disadvantages exist in prior art PDPs as illustrated in FIG. 1. The width of the sealing seam displayed on the edge part of the panel is hard to control in coating process and varies depending on the flowability of the glass powder. Consequently, the width of the peripheral edge of light-absent region on the plate is typically within the range of 10 mm–15 mm. It is a big width of the sealing seam. Unfortunately, this means that the light-absent area between adjacent units is noticeable to viewers, and there is a "mosaic" like appearance present on the screen, further degrading the images provided thereby.

SUMMARY OF THE INVENTION

Accordingly, in consideration of the disadvantages of PDPs exist in the art, a primary object of the present invention is to provide a multi-screen PDP having improved, narrower sealing parts.

The PDP for multi-screen system of the present invention has a web-less appearance. Special sealing material and construction of the present invention prevent the images from missing between the adjacent units in the display matrix, thereby advantageously eliminating the dark matrix border lines.

To accomplish the object, the present invention provides a new and inventive PDP comprising a front glass substrate (plate) having transparent electrodes, dielectric layer and protective layer, and a back glass substrate (plate) having addressing electrodes, dielectric layer, and barrier ribs (spacer partition wall). The transparent electrodes and addressing electrodes are orthogonally located between said plates. The transparent electrodes are parallel to each other and are arranged in the display region at a predetermined pitch.

The addressing electrodes have a similar arrangement. The transparent electrodes and the addressing electrodes form a so-called matrix structure. A peripheral portion of the electrode extends outwardly beyond the partition wall, which is the outer end. Both kinds of electrodes are bended and contacted with the peripheral side wall of the plates, extending from the peripheral side wall and turn to the bottom surface of the back plate. The electrodes of both kinds may be the belt-like electrodes.

Electrodes and barrier ribs separate and define display cells from each other. The cells between adjacent barrier ribs (spacer partition wall) have phosphor layers deposited within it. The barrier ribs also separate the front plate and the back plate to form a discharge space therebetween.

The front plate and back plates are bonded or sealed together with lower melting point glass powder. The lower melting point glass powder is heated under the confining temperature. In the sealing procedure, to improve the air-tightness, a concave groove that accommodates the sealing material may be used. The concave groove is constituted on the edge of inside surfaces of the plates, along a sealing seam between the two plates.

The sealing seam may have such a section characterized as having a shape of semi-circle, rectangular, triangle, or trapezoid. The sealing seam may occupy the space given by the front plate or on the back plate, or the both. The groove may have a depth from about 0.05 mm to about 2.0 mm from the side-wall of the PDP. The mouth of the groove opens outwardly. The open mouth may have a width from about 0.05 mm to about 0.5 mm.

The size of the back plate may be smaller than the size of the front plate from about 0.3 mm to about 1.5 mm when the sealing seam is arranged on inside surface along the edge of the front plate. The sealing material is embedded in the concave groove along the joint seams between the two plates by coating or screen-printing. The special sealing compositions comprises PbO, $SiO_2$, $B_2O_3$, $Al_2O_3$, ZnO, CaO. The PbO ranges from about 50 to about 80 (wt.)%. The $SiO_2$ ranges from about 2 to about 20 (wt.)%. The $B_2O_3$ ranges from about 10 to about 30 (wt.)%. The $Al_2O_3$ ranges from about 2 to about 18 (wt.)%. The ZnO ranges from about 3 to about 10 (wt.)%. The CaO ranges from about 2 to about 25 (wt.)%.

The granularity of the glass powder with lower melting point ranges from $1\mu$ to $10\mu$, and preferably about $5\mu$.

A method of manufacturing a plasma display panel according to the present invention comprises the following steps: First, preparing the front and back plates on the inside surface of the front plate, the back plate, or the both. A groove or part of the groove which is hollowed inwardly from the surface of peripheral side wall along the seam between the front and back plates may be worked on the side wall of the PDP. The front glass substrate is located at a display side of said panel. Second, set the transparent electrodes and addressing electrodes and their connection electrodes on the plates. Third, construct barrier ribs, dielectric layer, protective layer, and then depositing phosphor layer within the cell located on the back glass substrate. Fourth, seal the semi-finished assembly then draw off the residual gas from the space between front glass plate and back glass plate. After that, the inert gas is filled into the space to finish the work, forming an airtight PDP.

The sealing process has three steps, the first step is the construction of the sealing seam with lower melting point glass powder utilized as a filler of the groove through multi-overlapping to form a melting layer which has a width ranging from about 0.3 mm to about 1.5 mm and a thickness ranging from about 0.05 mm to about 0.2 mm. The multi-overlapping process may be carried out by utilizing screen-printing technology. Each print results in forming of a thickness ranging from about 0.01 mm to about 0.03 mm, preferably about 0.02 mm.

The second step of the sealing process is to clamp the front and back plates together with special tools holding them even up and tightly joined. The third step involves a heating process under a confining temperature of about 400° C. to about 480° C. The coating process may be optionally used in forming the melting layer.

Still further objects and advantages of the present invention will become apparent to one of ordinary skill in the art upon reading and understanding the detailed description of the preferred embodiments and the drawings illustrating the preferred embodiments disclosed hereinafter.

DETAILED DESCRIPTION OF THE PREFERRED EMBODIMENTS

The present invention offers a solution to the above-mentioned problems and disadvantages exist in prior art PDPs. Accordingly, it is an object of the present invention to provide an image display device having a large screen composed of a plurality of display panels capable of displaying a natural image on a large screen without noticeable connected portion of the display panels.

Figure 1:
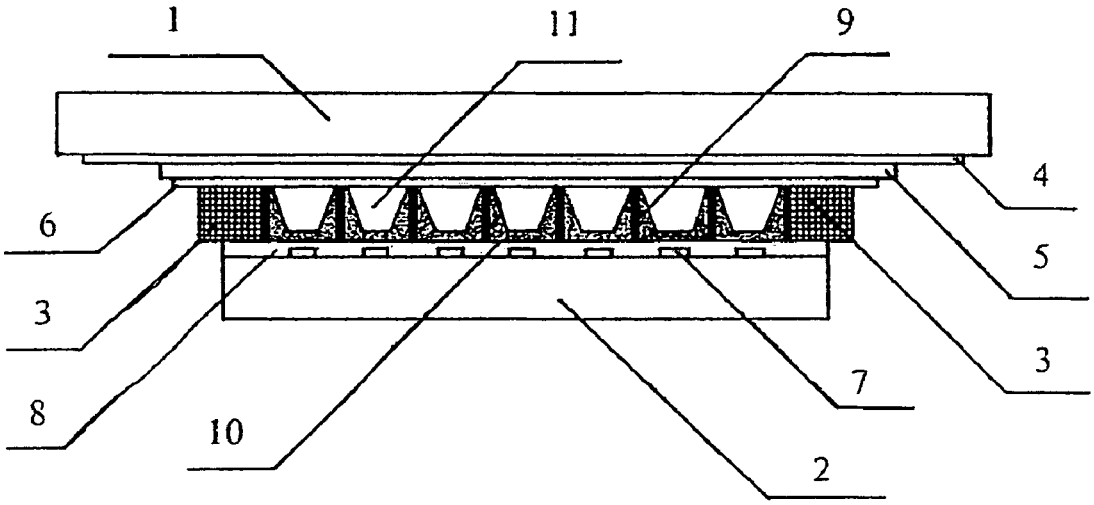
FIG. 1 (PRIOR ART)
FIG. 1 illustrates an exemplary prior art PDP.
Figure 2:
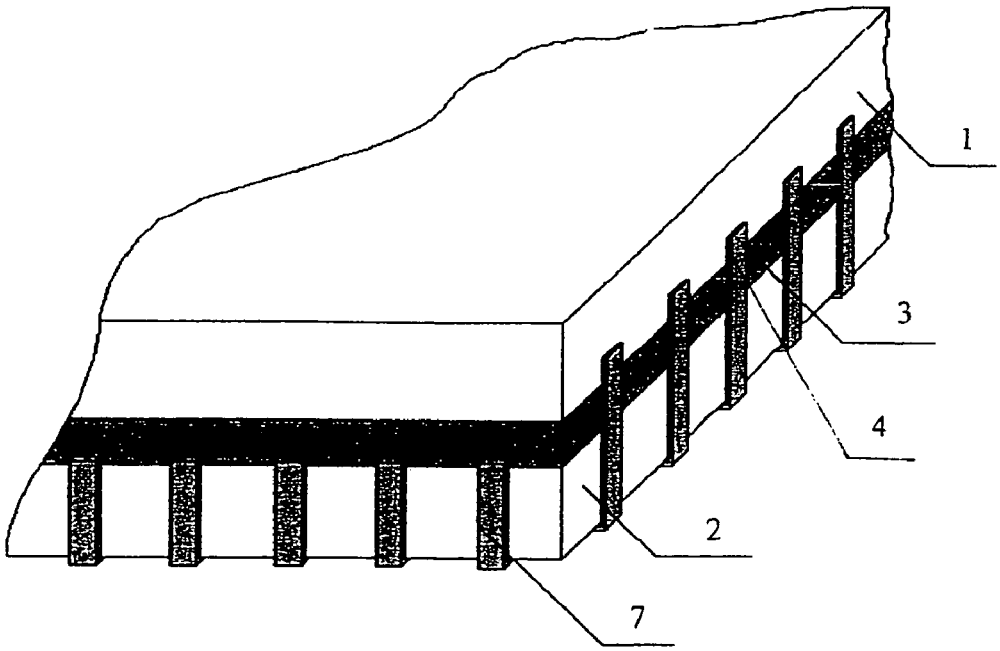
FIG. 2 is a diagrammatic perspective view of the PDP of the first embodiment of the present invention.
Figure 3:
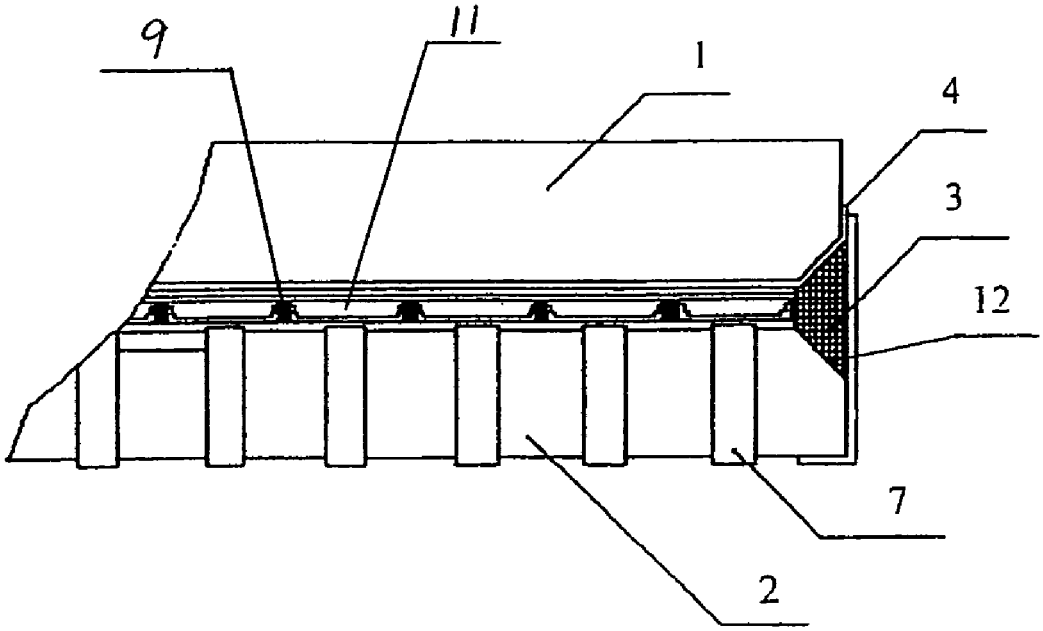
FIG. 3 is a diagrammatic sectional view of FIG. 2.

Referring to FIGS. 2 and 3, there is shown a first embodiment of the plasma display panel in accordance with the present invention. This embodiment discloses a plasma display panel (PDP) with a very narrow sealing seam 3 which surrounds the peripheral edges at the joint seam and provides an airtight bonding between a front plate 1 and a back substrate 2 of the PDP for multi-screen system. The front glass substrate (or plate) 1 and the back glass substrate (or plate) 2 are separated from each other, forming a discharge space therebetween.

The discharge space is partitioned by a partition wall 9 into a number of pixels (display cells) 11. The partition wall (barrier ribs) 9 is in the form of a grid located between the front and the back glass substrates 1 and 2. Each of the pixels 11 is defined by the front glass substrate 1, the back glass substrate 2, the partition wall 9, and electrodes 4 and 7 as discussed below. The pixels 11 are separated from one another by the partition wall 9, i.e., the barrier ribs separate and define display cells from each other.

The electrodes 4 and 7 are located between the plates 1 and 2 and are mutually orthogonal. The transparent electrode 4 is formed directly on the front plate 1. The addressing electrodes 7 are arranged on the back substrate 2. The front plate 1 also has a dielectric layer 5 and a protective layer 6. Thus, there are addressing electrodes 7 and dielectric layer 8, barrier ribs 9 being arranged on the back substrate 2.

In this embodiment, the transparent electrodes 4 are scanning electrodes and the addressing electrodes 7 are signal electrodes. These electrodes form display cells 11 which are separated by barrier ribs 9. Phosphor 10 is located on back substrate 2 within each of the display cells (or pixels) 11. A sealing seam 3 for sealing the edge of the two plates 1 and 2 is embedded in a concave groove 12 along the joint seams between the two plates 1 and 2. The concave groove 12 has a section characterized as having a shape of trapezoid with its mouth opened outwardly. As illustrated in FIGS. 4–7, the section can have other shapes such as semi-circle, rectangular, triangle, and so on.

The size of the back plate may be smaller than the size of the front plate from about 0.3 mm to about 1.5 mm when the groove 12 is constructed on the front plate. A special lower melting point glass powder is utilized for sealing the front plate 1 and the back plate 2 together to form a PDP. Preferably, the sealing materials of the present invention adopt special compositions comprising PbO, $SiO_2$, $B_2O_3$, $Al_2O_3$, ZnO, CaO. More specifically, the composition would have the following formulas: (A) PbO 80(wt.)%, $SiO_2$ about 2(wt.)%; $B_2O_3$ about 11(wt.)%, $Al_2O_3$ about 2(wt.)%, ZnO 3(wt.)%, CaO about 2(wt.)%; (B) PbO 65(wt.)% $SiO_2$ about 10(wt.)%, $B_2O_3$ about 14(wt.)%, $Al_2O_3$ about 3(wt.)%, ZnO 5 (wt.)%, CaO about 3(wt.)%; (C) PbO 50(wt.)%, $SiO_2$ about 20(wt.)%; $B_2O_3$ about 18(wt.)%, $Al_2O_3$about 3(wt.)%, ZnO about 5(wt.)%, CaO about 4(wt.)%.

The groove 12 for accommodation of the sealing material may have such a section with a trapezoid shape. In some embodiments, the section has a depth from about 0.05 to about 2.0 mm. The groove 12 has a mouth that opens outwardly with its width ranging from about 0.05 mm to about 0.5 mm. The groove 12 may occupy a space on both of the inside surfaces of the front and back plates 1 and 2.

Figure 4:
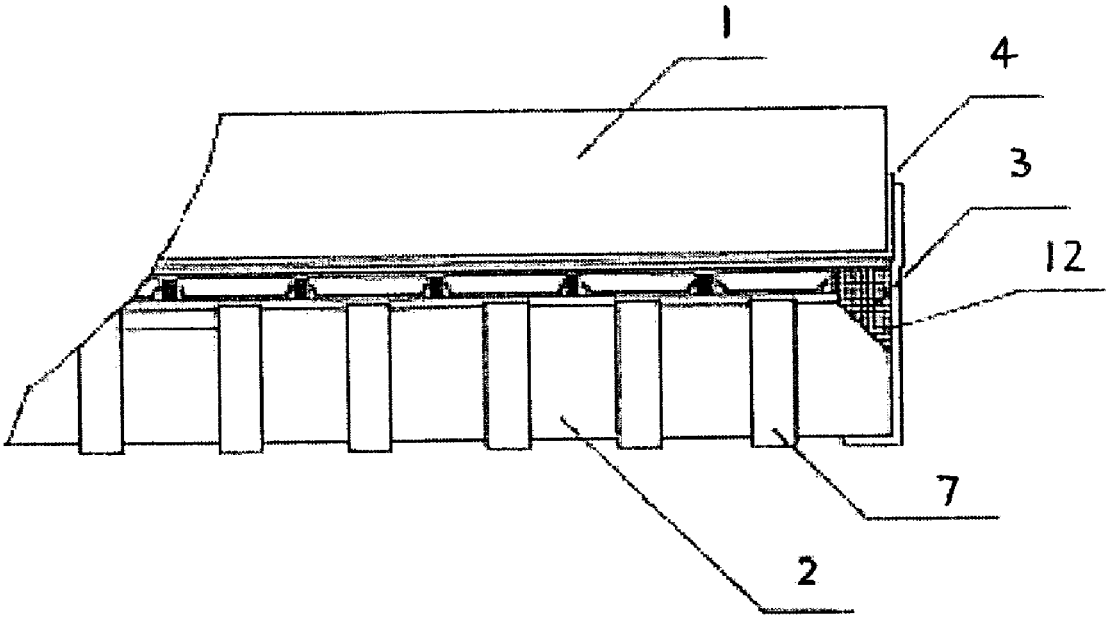
FIG. 4 diagrammatically shows the second embodiment of the present invention.

FIG. 4 illustrates the second embodiment, which has a similar structure to the PDP of the first embodiment. The composition of the sealing material is different and the groove 12 for accommodating the sealing material may have its section in a half-trapezoid shape. In this case, the composition of the sealing material comprises the following formulas: (A) PbO about 80(wt.)%, $SiO_2$ about 2(wt.)%; $B_2O_3$ about 11(wt.)%, $Al_2O_3$ about 2(wt.)%, ZnO about 3 (wt.)%, CaO about 2 (wt.)%; (B) PbO about 65 (wt.)%, $SiO_2$ about 10(wt.)%, $B_2O_3$ about 14(wt.)%, $Al_2O_3$ about 3 (wt.)%, ZnO about 5(wt.)%, CaO about 3(wt.)%; (C) PbO about 50(wt.)%, $SiO_2$ about 20(wt.)%; $B_2O_3$ about 18(wt.)%, $Al_2O_3$ about 3(wt.)%, ZnO about 5(wt.)%, CaO about 4(wt.)%. The groove 12 occupies the space of the back plate 2 at its peripheral parts.

Figure 5:
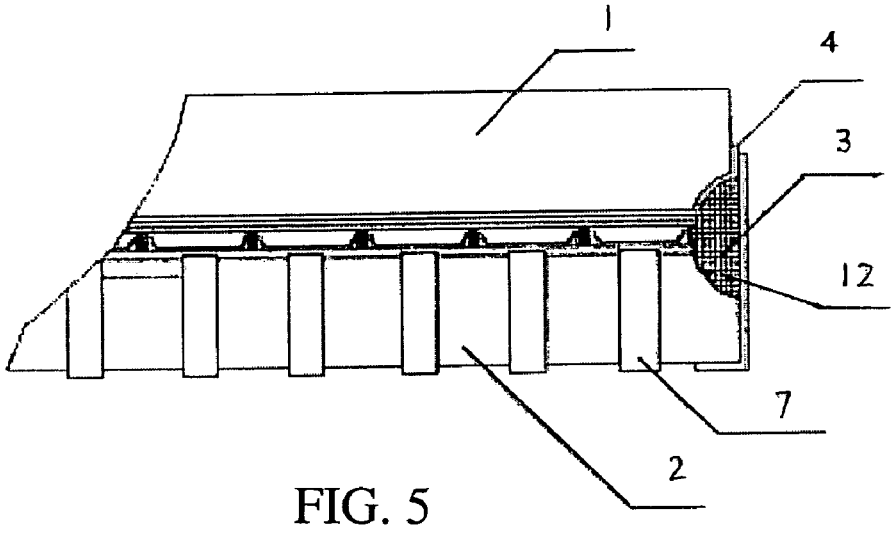
FIG. 5 diagrammatically shows the third embodiment of the present invention.

FIG. 5 shows the third embodiment, which has a structure similar to the PDP of the first embodiment. Here, the composition of the sealing material is different and the groove 12 for accommodating the sealing material may have its section in a semi-circle shape. In this case, the composition of the sealing material 3 has the following formulas: (A) PbO about 80(wt.)%, $SiO_2$ about 2(wt.)%; $B_2O_3$ about 11(wt.)%, $Al_2O_3$ about 2(wt.)%, ZnO about 3(wt.)%, CaO about 2(wt.)%; (B) PbO about 65 (wt.)% $SiO_2$ about 10(wt.)%, $B_2O_3$ about 14(wt.)%, $Al_2O_3$ about 3(wt.)%, ZnO about 5 (wt.)%, CaO about 3(wt.)%; (C) PbO about 50(wt.)%, $SiO_2$ about 20(wt.)%; $B_2O_3$ about 18(wt.)%, $Al_2O_3$ about 3(wt.)%, ZnO about 5(wt.)%, CaO about 4(wt.)%. The groove 12 occupies the space of both the front plate 1 and the back plate 2.

Figure 6:
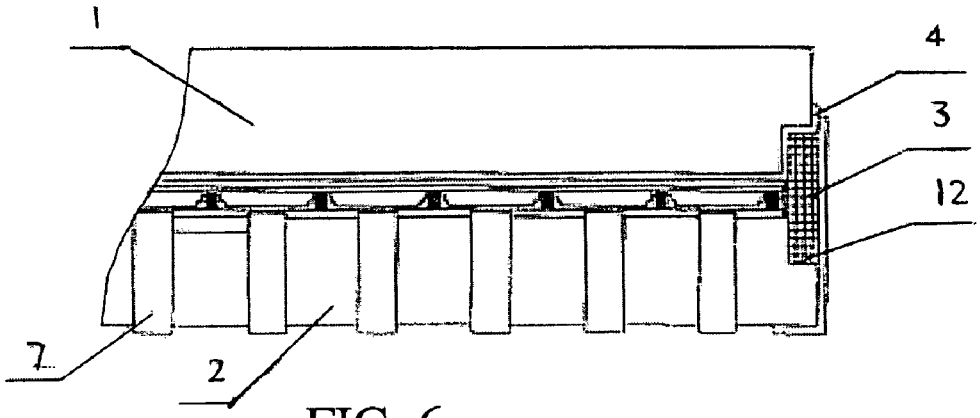
FIG. 6 diagrammatically shows the fourth embodiment of the present invention.

FIG. 6 diagrammatically shows the fourth embodiment, which has a structure similar to the PDP of the first embodiment. Again, the composition of the sealing material as well as the construction of groove 12 for accommodating the sealing material are different. The composition of the sealing material may utilize the formulas presented in any aforementioned embodiments. The shape of the section of the groove 12 is rectangular. It occupies a space on both the inside surface of the front plate 1 and the back plate 2.

Figure 7:
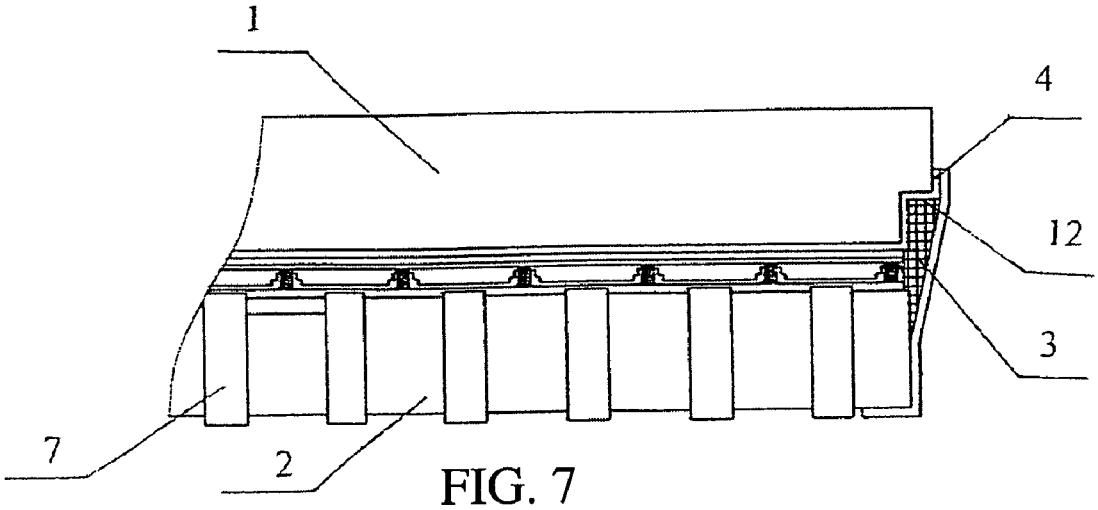
FIG. 7 diagrammatically shows the fifth embodiment of the present invention.

Shown in FIG. 7 is the fifth embodiment, which has a structure similar to the PDP of the first embodiment. Comparing with the first embodiment, the difference is at the composition of the sealing material 3 and the groove 12 for accommodating the sealing material 3. The composition of the sealing material may utilize the formulas presented in any aforementioned embodiments. The shape of the section of the groove 12 for accommodating the sealing material is triangle. It occupies a space on both the inside surface of the front plate 1 and the back plate 2. The size of the back plate 2 may be smaller than the size of the front plate 1 from about 0.3 mm to about 1.5 mm.

The invention has thus been shown and described with reference to the specific embodiments. However, the above mentioned embodiments has been disclosed only for illustrating usefulness of the plasma display panel in accordance with the present invention. Therefore, it should be noted that the present invention is in no way limited by the details of the illustrated structures. As one of ordinary skill in the art will appreciate, various changes, substitutions, and alterations could be made or otherwise implemented without departing from the principles of the present invention. Accordingly, the scope of the present invention should be determined by the appended claims and their legal equivalents.

We claim:

1. A plasma display panel for multi-screen system comprising a front dielectric plate and a back dielectric plate;

transparent electrodes and addressing electrodes orthogonally located between said front and back dielectric plates;

display cells defined by said transparent electrodes and said addressing electrodes;

barrier ribs for separating and defining said display cells from each other; and a sealing seam for sealing edge parts of said front and back dielectric plates, said sealing seam having a width ranging from about 0.3 mm to about 1.5 mm and said sealing seam having a sealing material composed of a glass powder with a low melting point.

2. The plasma display panel according to claim 1, wherein said sealing material occupies a space on inside surface of said front dielectric plate.

3. The plasma display panel according to claim 1, wherein said sealing material occupies a space on inside surface of said back dielectric plate.

4. The plasma display panel according to claim 1, wherein said sealing material occupies a space on both of said front and back dielectric plates.

5. The plasma display panel according to claim 1, wherein a shape of said sealing seam is characterized as rectangular.

6. The plasma display panel according to claim 1, wherein a shape of said sealing seam is characterized as semi-circle.

7. The plasma display panel according to claim 1, wherein a shape of said sealing seam is characterized as trapezoid.

8. The plasma display panel according to claim 1, wherein a shape of said sealing seam is characterized as triangular.

9. The plasma display panel according to claim 1, wherein said glass powder comprises:

PbO, ranging from about 50 to about 80 (wt.)% of the total composition, $SiO_2$, ranging from about 2 to about 20 (wt.)% of the total composition, $B_2O_3$, ranging from about 10 to about 30 (wt.)% of the total composition, $Al_2O_3$, ranging from about 2 to about 18 (wt.)% of the total composition, ZnO, ranging from about 3 to about 10 (wt.)% of the total composition, CaO, ranging from about 2 to about 25 (wt.)% of the total composition.

10. A method of manufacturing the plasma display panel of claim 1 comprising the steps of:

preparing said front and back dielectric plates;

setting said transparent electrodes, said addressing electrodes, and their connection electrodes on said front and back dielectric plates;

constructing barrier ribs, at least one dielectric layer, and at least one protective layer;

depositing phosphor layers into display cells;

clamping said front and back dielectric plates even and tightly together;

forming a seam of filler with said low melting point glass powder;

heating the semi-finished assembly of the plasma display panel formed through above steps under a confining temperature of about 400° C. to about 480° C., melting said glass powder filler to form said sealing seam of about 0.3 mm to about 1.5 mm in width and of about 0.05 mm to about 0.2 mm in thickness, thereby forming the plasma display panel airtight.

11. A method of manufacturing the plasma display panel according to claim 1, wherein said sealing seam is formed through an overlapping screen printing process.

* * * * *

UNITED STATES PATENT AND TRADEMARK OFFICE

CERTIFICATE OF CORRECTION

PATENT NO. : 6,967,441 B2
APPLICATION NO. : 10/748005
DATED : November 22, 2005
INVENTOR(S) : Boyan Sun and Yiting Yu It is certified that error appears in the above-identified patent and that said Letters Patent is hereby corrected as shown below:

On Title page item 73

Kindly add the Assignee : Boyan Sun, (CN).

The Assignees should correctly read :

Ningbo Tianming Electronic Co. Ltd. (CN)
Boyan Sun (CN)

Signed and Sealed this

Twenty-seventh Day of February, 2007

JON W. DUDAS
*Director of the United States Patent and Trademark Office*